US005725737A

United States Patent [19]

Pikulik et al.

[11] Patent Number: 5,725,737

[45] Date of Patent: Mar. 10, 1998

[54] APPARATUS FOR THE DETECTION OF HOLES AND PLUGGED SPOTS

[75] Inventors: Ivan I. Pikulik, Pointe Claire; P. Daniel Gilbert; Jean Hamel, both of Dorval, all of Canada

[73] Assignee: Pulp and Paper Research Institute of Canada, Pointe Claire, Canada

[21] Appl. No.: 710,519

[22] Filed: Sep. 18, 1996

[51] Int. Cl.[6] ..... G01N 15/08; D21F 7/06

[52] U.S. Cl. ..... 162/263; 162/275; 162/198; 73/38; 73/37.7

[58] Field of Search ..... 162/263, 275, 162/198; 73/38, 37.7, 37

[56] References Cited

U.S. PATENT DOCUMENTS

| | | | |
|---|---|---|---|
| 3,577,767 | 5/1971 | Stedile | 73/38 |
| 3,762,211 | 10/1973 | Poulsen | 73/38 |
| 4,385,517 | 5/1983 | Sorce et al. | 73/38 |
| 4,401,147 | 8/1983 | Beck et al. | 162/263 |
| 4,555,934 | 12/1985 | Freeman et al. | 73/38 |
| 4,880,499 | 11/1989 | Pikulik | 162/198 |
| 4,892,621 | 1/1990 | Eskelinen | 162/198 |
| 5,349,845 | 9/1994 | Blom | 73/38 |
| 5,412,976 | 5/1995 | Vogt | 73/38 |

*Primary Examiner*—Peter Chin
*Assistant Examiner*—Jose A. Fortuna
*Attorney, Agent, or Firm*—Swabey Ogilvy Renault

[57] ABSTRACT

The invention relates to an apparatus for detecting plugged sites and holes and for measuring of the water permeability properties of pervious machine fabrics. Plugged sites in a permeable fabric are detected by sensing water pressure pulses occurring in the nozzle at the moment when a stream of water flowing through the nozzle contacts a plugged site on a fast running fabric. The apparatus can be used on-line to simultaneously detect plugged sites and holes on a moving pervious fabric while monitoring its water permeability properties.

7 Claims, 7 Drawing Sheets

APPARATUS FOR THE DETECTION OF HOLES AND PLUGGED SPOTS

BACKGROUND OF THE INVENTION

1. Field of the Invention

The present invention relates to a method and apparatus for the detection of plugged sites and holes of pervious fabrics. More particularly this invention relates to an on-line method and an apparatus for detecting plugged sites and holes in a pervious fabric while monitoring the water permeability properties of the fabric.

2. Background of the Invention

In the forming section of a paper machine, a flat jet of a dilute, aqueous fibrous pulp suspension is injected onto the surface of a specially designed pervious textile called a forming fabric or wire or into a converging gap formed by two such fabrics. The bulk of water in the suspension is rapidly drained through one or both of the pervious fabrics while a large portion of fibers is retained on the fabric surface. The wet web, formed in this manner, is further dewatered, in the press section on press fabrics or felts and finally, in the drying section, on drying fabrics. Thus the function of the fabrics is to allow rapid drainage of water, while retaining the largest possible uniform fraction of fibers from the suspension. Only a fraction of a second is available for water drainage on rapidly-operating, modern paper machines. Therefore, for good machine operation, it is critical that the drainage occur rapidly and that the fabrics are properly designed and kept clean to have good water permeability properties.

The process water used in papermaking usually contains various dispersed and colloidal sticky components originating from wood, recycled paper, or from various papermaking additives. These materials are generally hydrophobic and have a tendency to deposit on machine parts, notably on the fabrics in the forming, pressing and drying sections, causing machine operation problems and resulting in poor paper quality. These problems can be particularly severe on machines producing paper from resinous wood, and from recycled paper which often contains glue, latex from paper coating, and other impurities. This matter is dispersed in the process water and, during papermaking, forms undesirable coated sites on the filaments of fabrics thus blocking their interstices.

When fabric is coated by stickies, the water drainage efficiency of the fabric is lowered at the site area to a point where the properties of the formed fibrous web are detrimentally affected. The web leaving the forming section has an unacceptably high moisture content, is weak and readily breaks causing an expensive loss of production. Even if the wet web does not break, it could be damaged by holes, wrinkling, excessive stretching, or other defects which reduce the quality of the final product. To overcome these problems machine speed is reduced, and the entire fabric is chemically cleaned. This can lead to a costly decrease in production.

Under suitable conditions the dispersed, colloidal and dissolved organic components present in the fibrous suspension can coagulate to form larger agglomerates called stickies. When stickies deposit onto the surface of a fabric, they can partially or completely plug an area of its surface. Typically the diameter of these plugged sites ranges from several millimetres to several centimetres, however the plugged areas can be even larger. As water cannot flow through the plugged sites, few if any fibers are deposited in the plugged areas. This can result in holes or light spots in the paper sheet. The fabric must be chemically cleaned to overcome these problems.

To maintain the water permeability of fabrics at an acceptable level, the fabrics are continuously cleaned by low-pressure showers and periodically by high-pressure showers. Furthermore, in some mills on scheduled shut-downs, the fabrics are thoroughly cleaned with strong chemical agents. When the water permeability of the fabrics drop to a level at which problems with paper machine runnability or product quality become unacceptable, the machine is stopped and the fabrics are cleaned using stronger chemical agents such as caustics, detergents or organic solvents. Such unscheduled shut-downs cause costly production losses.

It would be desirable to monitor on-line the condition of the fabrics in a paper making machine for plugged sites and holes. One could then practice localized preventive cleaning in order to avoid major disruptions of production necessitated by a drop in water permeability properties of the fabrics. An apparatus capable of monitoring the condition of fast running fabrics during the operation of a paper machine would be required, but no such apparatus is available at present.

Although the holes in the fabric could be detected by a hole detector, no sensor is available at present for the detection of light spots. Therefore many tons of paper containing this defect could be produced before the problem is recognized and the correction, such as a shut-down for fabric cleaning, is made.

Permeability is a key performance characteristic of all paper machine fabrics and is generally tailored by the manufacturer and specified by the user. Permeability is commonly characterised in terms of permeability to air at a pressure differential of 0.12 kPa (equal to the weight of a 0.5 inch high column of water). Examples of commercial instruments available for the measurement of permeability to air include those described in U.S. Pat. Nos. 3,762,211 and 4,401,147. The usefulness of these instruments to monitor, on-line, the condition of the fabrics used in a paper making machine for plugged sites and holes is doubtful. The pressure differential used to enhance the water drainage through the fabric has peaks close to 70 kPa, a value many times greater than that used in the measurement of a fabric's air permeability. It is therefore widely recognized both by suppliers and users that fabric air permeability measurement is at best a crude, inadequate indicator of a fabric's performance.

Instruments for the measurement of water permeability of machine fabrics are sometimes used by suppliers, but these measurements are generally made in the laboratory on samples of new felts which have to be clamped to a stationary apparatus (U.S. Pat. Nos. 3,577,767 and 4,385,517). These conventional water permeability instruments can be used to study the permeability of new fabrics or used fabrics but they are not suitable for on-line measurement of permeability of paper machine fabrics. None of these instruments is capable of detecting holes in forming fabrics.

The method of testing water permeability disclosed in U.S. Pat. No. 4,880,499, can only be employed for determining a fabrics water permeability at different positions in the cross direction (CD). Because the method is slow one can, at most, measure only a few readings during the time the fabric completes one machine loop which, on a rapid paper machine, takes less than one second. Enough data can be generated at various points in the (CD) cross direction to measure the average (CD) fabric water permeability and the CD permeability profile, all useful information concerning the overall drainage characteristics of a fabric. The method is not suitable for measuring water permeability in the machine direction (MD). Neither can it be used to detect plugged sites or holes on the fabric.

None of the existing prior art instruments can be employed to detect, in a rapidly advancing fabric, a property which can be attributed to a very small fabric area plugged by stickies or to small perforations. For example a plugged area or a hole with a diameter of 5 mm on a fabric running at 20 m/s would pass under a sensor with a diameter of 5 mm in just 0.4 millisecond. If the complete measurement takes 0.2 seconds, the permeability reading is the average permeability of a one metre long strip of fabric. Therefore, the 5 mm long plugged area or hole represents only 0.5% of the total area, and does not influence the value of the measured average permeability in a significant way.

Thus, it would be highly desirable to have a method and an instrument which could not only be employed to measure average (CD) fabric water permeability and CD permeability profile but also to measure machine direction (MD) profile of water permeability of a fabric and detect plugged areas and holes in the fabric.

SUMMARY OF THE INVENTION

It is an object of this invention to provide a method and apparatus for detecting plugged sites and holes in a water pervious fabric in a paper machine, and especially in a running paper machine.

It is a further object of the invention to provide a method and apparatus for detecting plugged sites and holes in a water pervious fabric in a paper machine, especially in a running paper machine, and to measure the machine direction (MD) profile of the water permeability of the fabric.

It is a still further object of the invention to provide a method and apparatus for detecting plugged sites and holes in water pervious paper machine fabrics such as forming wires, press felts or drying fabrics.

In accordance with one aspect of the invention there is provided a method for detecting plugged sites and holes in a water pervious fabric in a paper making machine comprising:

i) engaging a nozzle to the pervious fabric surface, said nozzle having a nozzle head having an orifice through which a stream of water from said nozzle can be ejected onto said surface;

feeding a stream of water through said nozzle and ejecting the stream of water outwardly of the nozzle orifice, under pressure, as a water flow, through interstices of the pervious fabric;

iii) sensing, within said nozzle, any pressure pulse change developed in said stream responsive to an interruption of the water flow through the interstices, and attributing said change to a detection of either a plugged site or a hole in the fabric.

Preferably the nozzle engagement with the water pervious fabric surface in (i) is made in an area of the fabric that is not in contact with the pulp suspension or wet web being formed, dewatered or dried; and steps ii) and iii) are carried out while the paper-making machine is running.

The nozzle head in (i) is preferably smooth, having a rounded outer face engaging the surface of the fabric, free of any sharp edges so as not to damage the costly fabric material.

In accordance with another aspect of the invention there is provided improvements in a paper-making assembly consisting of a forming section for dewatering an aqueous pulp suspension to form a wet web while in contact with a pervious, traveling forming (fabric) wire, a pressing section for further dewatering the wet web while in contact with a pervious, traveling press (fabric) felt and a drying section for drying the pressed web while in contact with a pervious, traveling, drying fabric, said assembly having:

i) nozzle means for directing, under an essentially constant pressure, a stream of water onto at least one of said forming fabric, said press fabric and said drying fabric, and;

ii) a pressure pulse sensor operably housed in said nozzle means for sensing pressure pulse changes developed in the stream, responsive to interruptions of water flow through said at least one pervious fabric.

DESCRIPTION OF PREFERRED EMBODIMENTS OF THE INVENTION

For the sake of simplicity, the method of our invention is particularly explained by reference to the detection of plugged sites or holes in a forming fabric of a paper machine even though the detection can be made equally well in a press felt or dryer fabric.

In the method according to this invention the hydrodynamics of the water flow through the nozzle are used to detect the plugged sites or holes. The pressurized stream of water flowing through the nozzle cannot suddenly stop, even for a fraction of a millisecond, when the stream comes in contact with a plugged site on the rapidly-moving fabric. We have found, however, that water streaming towards the plugged site exiting from the nozzle impinges on the plugged site and creates a brief but intensive pulse of high pressure. A rapidly responding dynamic pressure sensor was used to readily detect the sharp pressure pulse. In the case of a plugged site detection, the pulse signal was positive while in the case of a hole detection the pulse signal was weaker and negative.

In the apparatus of the instant invention a pressure sensor was operably housed in the nozzle by drilling a hole directly into the water nozzle, about 20 mm from its end. The pressure pulse or shock developed in the ejected stream of water as it contacts a plugged site travels at the speed of sound in water. The pulse or shock can be monitored through the entire stream of water from the pressure regulator to the orifice of the nozzle. Consequently, the pressure sensor can be connected to any convenient location between these points. However, we have found that positioning the sensor in the nozzle provides the clearest and least distorted pulse signal. The pressure gauge need not be very accurate, as it is used to detect pressure peaks rather than to quantify their magnitude.

The pulse sensor of plugged sites according to this invention has several important advantages. The pressure signal is recorded instantaneously (within a millisecond) the moment the stream of water from the nozzle comes into contact with a plugged site. On a fast-running paper machine, the forming fabrics run a complete loop in about one second and, during this time the pulse sensor can register several hundreds of pressure pulses. This finding has made it possible to identify not only the CD (cross-direction) position but also the MD (machine-direction) position of plugged sites.

Suitable software can be employed to display the permeability profiles in cross-machine direction and machine direction, and indicate the CD and MD position of the plugged sites. Information about the exact position of the plugged sites on the fabric can then be used to aim a high pressure shower or a chemical delivery system at that position. This enables cleaning of only the plugged area, thus minimizing the cost of cleaning, and maintaining the quality of the finished paper product while extending the life of the fabric by voiding the negative impact of cleaning the entire surface area of the fabric.

The pulse sensor is employed in like manner to detect holes in the fabric, however, in this case the pulse signal is weaker and negative, relative to the impinging stream. Information about the exact position and size of a detected hole in the fabric can then be used to take corrective action. For example, a short term patch can be employed on small holes or, if the problem is more serious, a complete new change of fabric may be necessary to maintain the quality of the finished paper product.

The dimensions of the nozzle may conveniently be the same as in the method for determining water permeability of the fabric described in U.S. Pat. No. 4,880,499. In this way, the same nozzle, adapted with a pulse sensor, can be employed to detect plugged sites and to measure water permeability at the same time.

Additional elements may conveniently be used to enable the measurements to be made more easily and to improve the instruments performance. In particular, the readings of the water pressure indicator, the water flow regulator and the pressure pulse signals can all be processed by a data processing unit.

In a preferred embodiment, the entire apparatus may be supported by a holder mounted to travel back and forth in the cross-direction of the traveling fabric, with equipment being provided to effect such travel so that the nozzle is continuously shifted back and forth across the fabric to obtain a cross-machine permeability profile and cross-machine detection of plugged sites and holes.

A computer can also be employed to receive a signal indicating the position of the nozzle in the paper machine cross direction, to construct a CD profile of fabric permeability and to indicate the CD position of each plugged site. A sensor detecting each turn of the fabric as it proceeds around the loop on the paper machine can be added, and its output can be used to determine the measured position in the machine direction of the fabric. A reading of such a sensor could be used to determine the MD permeability profile and the MD positions of the plugged sites.

It is also advisable to connect the apparatus to a source of filtered water.

DETAILED DESCRIPTION OF PREFERRED EMBODIMENTS WITH REFERENCE TO THE DRAWINGS

Figure 1:
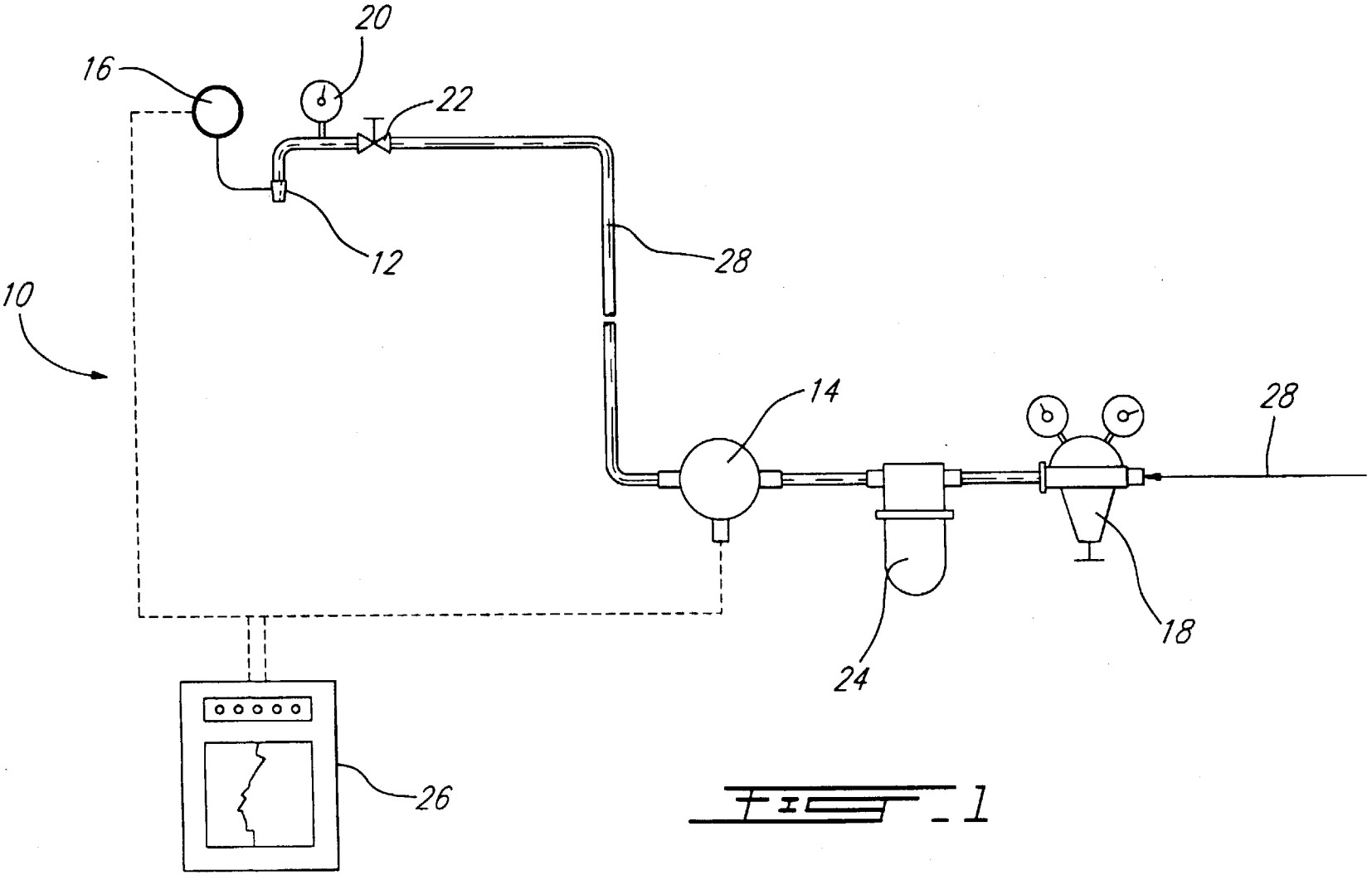
FIG. 1 is a schematic representation of the apparatus for the detection of plugged sites or holes, and the measurement of water permeability of a pervious fabric in accordance with the invention.

With further reference to FIG. 1, apparatus 10 for measuring water permeability and detecting plugged sites and holes in a pervious sheet includes a nozzle 12, a flow meter 14, a pressure pulse sensor or transducer 16, a water pressure regulator 18 and a pressure indicator 20.

Water line 28, in which flow meter 14, pressure sensor 16, regulator 18 and indicator 20 are disposed, feeds a stream of water to nozzle 12.

A valve 22 and a filter 24 are also disposed in water line or conduit means 28.

A data processing unit 26 is connected to flow meter 14 and pressure sensor 16.

Figure 2:
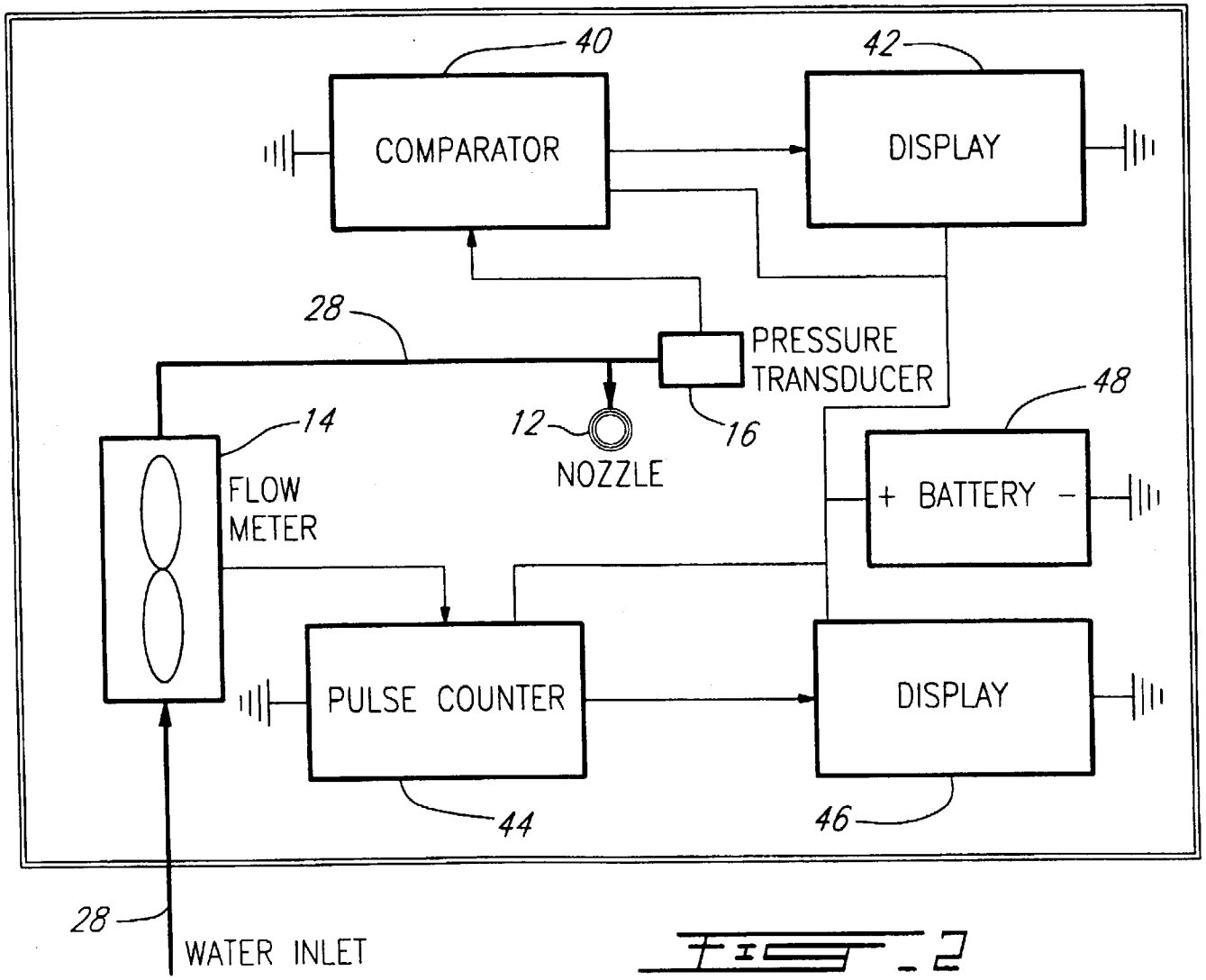
FIG. 2 is a block diagram illustrating the measuring and detecting apparatus of the invention.

FIG. 2 illustrates in a block diagram the relationship between nozzle 12, flow meter 14, pressure sensor or transducer 16 and components of the data processing unit 26 of FIG. 1. In particular the components shown in FIG. 2 include comparator 40 and display 42; pulse counter 44 and display 46 and a battery 48.

Figure 3:
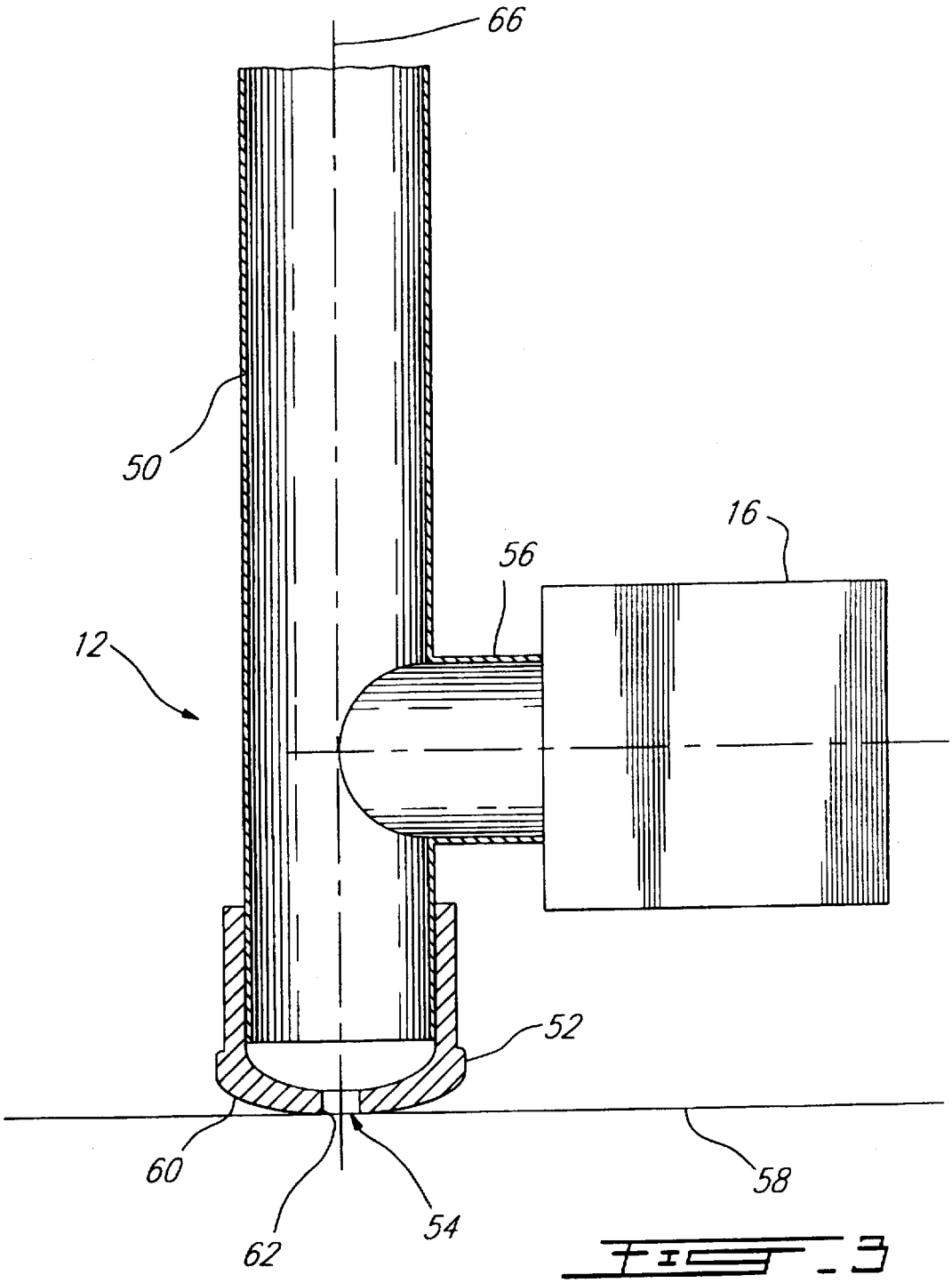
FIG. 3 is a schematic representation of a typical nozzle of the invention, engaging the surface of a fabric.

With reference to FIG. 3, nozzle 12 includes an elongate conduit 50 and a nozzle head 52 having an orifice 54.

Pressure sensor transducer 16 is operably housed in nozzle 12 through branch conduit 56, a side extension of conduit 50.

Nozzle head 52 has an outer face 60 and an inner face 62. Outer face 60 is smooth and rounded and curvedly merges with interface 62.

Nozzle head 52 is shown in contact engagement with forming fabric 58 at a right angle to it. The smooth rounded outer and inner faces 60 and 62 are free of sharp edges which could otherwise mark or seriously damage the fabric 58.

In operation of apparatus 10, water is fed under pressure in water line 28 and is ejected as a water stream through nozzle 12. Pressure regulator 18 ensures a constant set pressure of water is fed to line 28 and nozzle 12.

Flow meter 14 measures the rate of water flow through nozzle 12. The water permeability of the pervious fabric is measured in terms of this water flow at constant water pressure. Indicator 20 upstream of nozzle 12 verifies that the water pressure at nozzle 12 is set at the required value and is held constant throughout.

The water fed through line 28 may optionally be filtered in filter 24 to remove contaminants which might affect the operation of apparatus.

The nozzle 12 engages the surface of fabric at a right angle to it, as illustrated in FIG. 3 more especially a central longitudinal axis 66 of nozzle 12 extends perpendicularly of the fabric 58. The fabric 58 is typically traveling at high machine speed (machine not shown) and the nozzle 12 is shifted back and forth in the cross-direction of fabric 58.

Data processing unit 26 receives, stores and displays data received from flow meter 14 as a measure of water permeability of the forming fabric 58, and from pressure sensor or transducer 16 as a detection of a plugged site or hole in fabric 58.

The specifics of the display of the two parameters is more particularly illustrated in FIG. 2.

Nozzle 12 serves two functions. The first is to force the stream of pressurized water into the interstices of the fabric. The fabric is normally woven from small diameter filaments with a mesh as high as 100 knuckles per inch. To prevent any friction damage of the rapidly-advancing fabric, the head of nozzle 12 should have a large external diameter, be rounded and smoothly polished, both externally and internally.

The flow rate of water from the nozzle 12 into the fabric is proportional to the fabric's permeability. However, this proportionality is not linear. If the internal diameter of the nozzle or its orifice is too small, the resulting water jet is very small, and a large proportion of water pressure is used to overcome the friction between the water jet and the nozzle walls.

The second function of the nozzle 12 is to provide conditions for detecting pressure pulses attributed to the detection of a plugged site. For this purpose, a channel is drilled in the side of a nozzle and it is connected by branch conduit 56 to a sensitive piezoelectric pressure detector 16. Under regular operating conditions the pressure sensor 16 detects only very low pressure, as most of the water pressure in nozzle 12 is converted to the kinetic energy of the flowing water. However, if a plugged area of the fabric suddenly passes by nozzle 12, the column of the water rushing towards the orifice 54 is momentarily blocked, and all its kinetic energy is converted to a pressure pulse. The pressure that momentarily builds in the nozzle 12 might be greater than the pressure in the external water source. This pressure shock advances through the column of water at the velocity of sound in water, specifically about 1440 m/s where it is detected by the pressure sensor. At this speed the detection of the plugged site is instantaneous.

A strong pressure pulse is detected only if a substantial portion of the area under the nozzle is plugged. Plugged sites as small as a few square millimetres can cause problems with the quality of paper formation. To make sure that these small plugged sites are properly detected, a nozzle with an internal diameter of 4.9 mm and an internal cross section area of about 19 square millimetres was used in an experiment. We reliably detect a plugged site having a diameter of 2.5 mm and an area of about 5 square millimetres with such a nozzle. We have found that the optimum nozzle size is a compromise between an accurate measurement of the overall permeability and the ability to detect a plugged site. Generally, a nozzle with an internal diameter of close to 5 mm adequately performs both these functions.

It will be understood that the rounded, smooth faces of the nozzle described herein need not conform to a perfect circle, and the references to the diameter are not intended to indicate curvature of a perfect circle; any smooth rounded surface void of sharp corners or edges which could mark or damage the pervious fabric during contact, may be employed. Reference to "diameter" is convenient for identifying a curved surface and degree of curvature.

Figure 4:
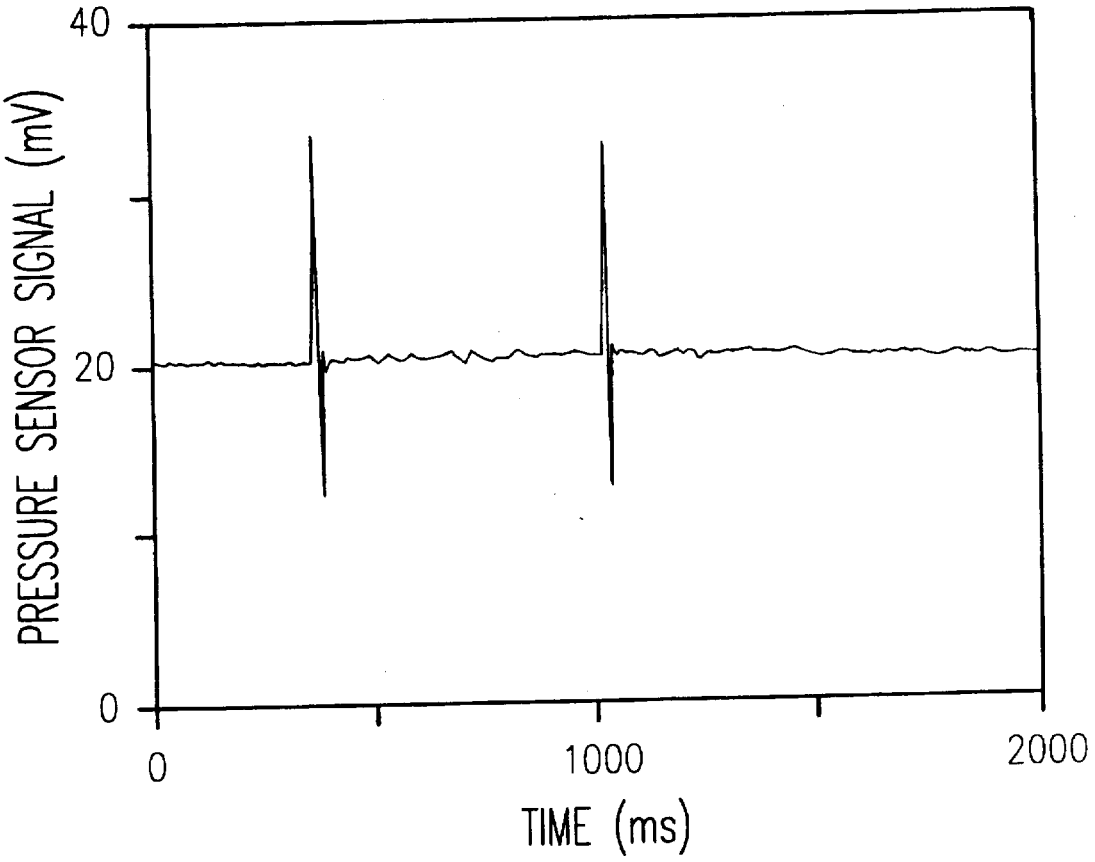
FIGS. 4, 5 and 6 are pressure pulse plots of two detected plugged sites in a fabric traveling at 100, 400 and 1200 mm/min, respectively.
Figure 5:
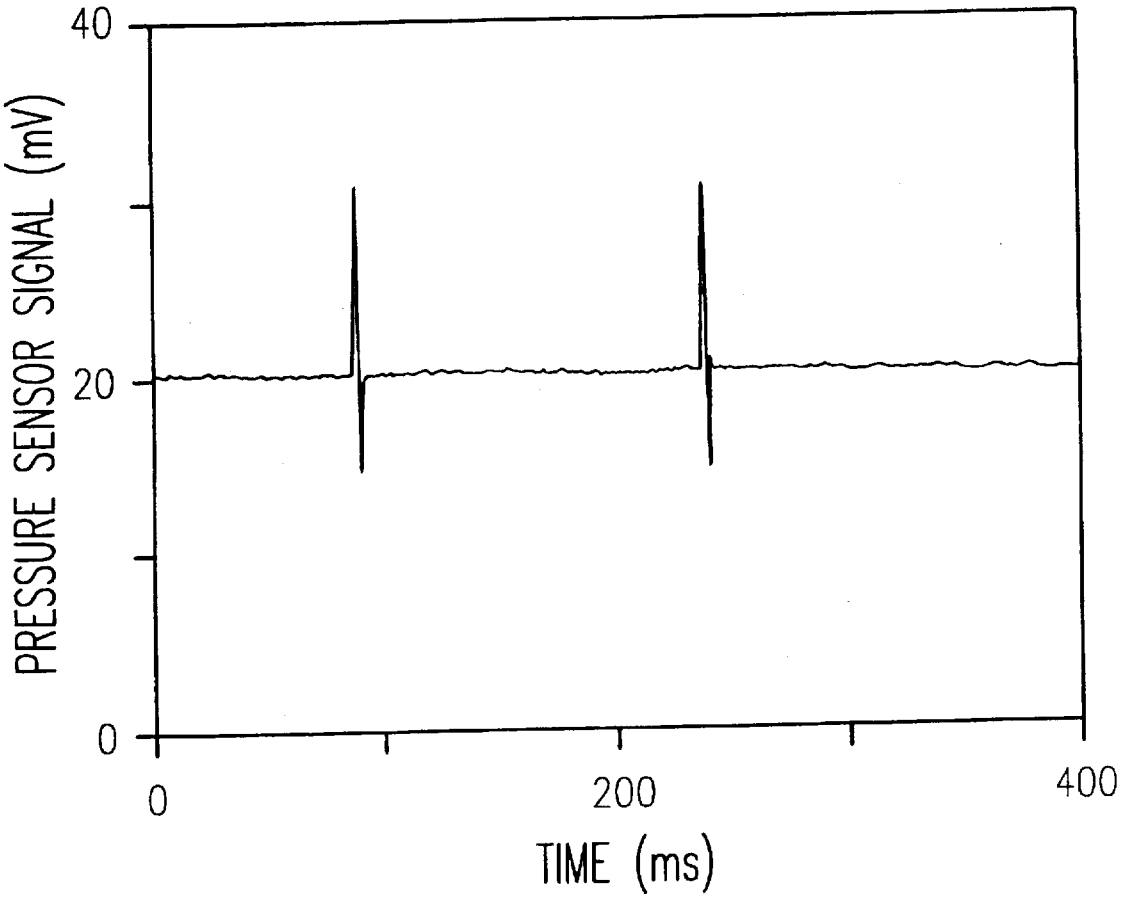
Figure 6:
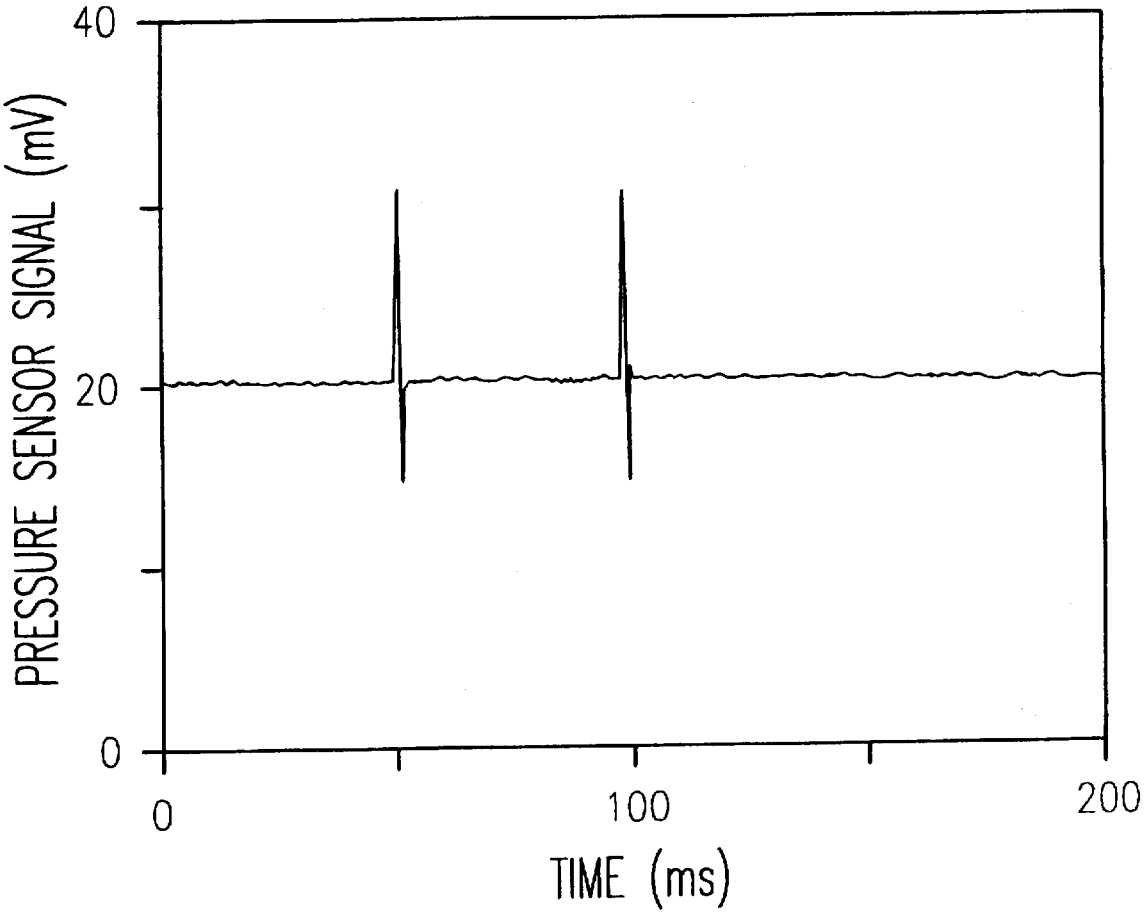

FIGS. 4, 5 and 6 show pressure pulses generated by two plugged spots with a diameter of 2.5 mm on a forming fabric advancing at 100, 400 and 1200 m/min. From these figures it is clear that signals are clearly discernible from the background noise and the intensity of signal is not significantly diminished with increasing fabric speed- Clear pressure pulses were measured at the highest speed attainable by the pilot paper machine, namely, at 1830 m/min. A hole in the forming fabric resulted in a smaller and negative pressure pulse.

Figure 7:
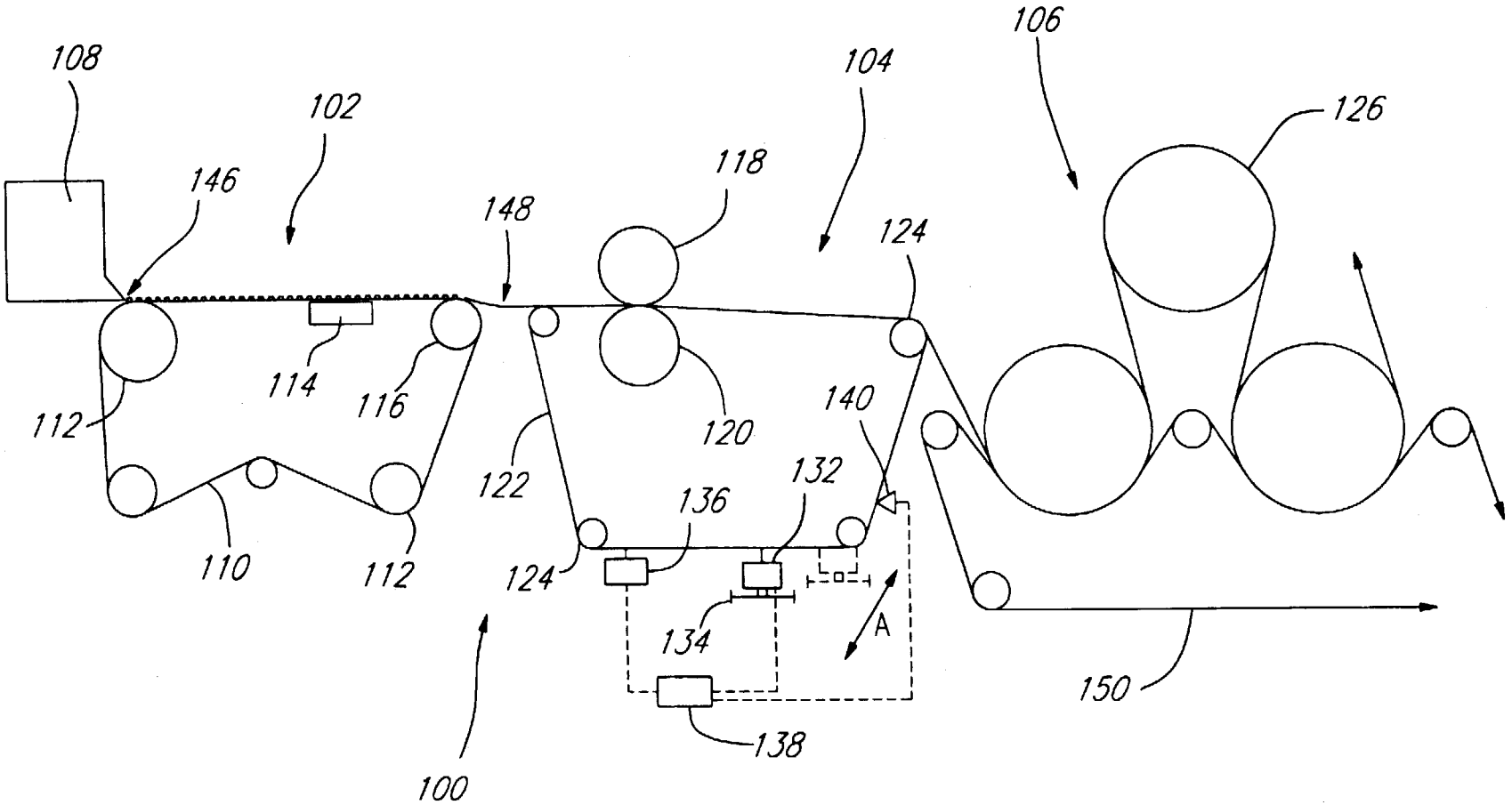
FIG. 7 is a schematic representation of a paper making machine assembly incorporating the apparatus of the invention.

With further reference to FIG. 7 there is illustrated schematically a paper making machine assembly 100 having a forming section 102, a press section 104 and a drying section 106 of conventional form.

Forming section 102 includes head box 108, a traveling fabric 110 traveling around rolls 112, a suction box 114 and a vacuum couch roll 116, all of conventional construction.

Press section 104 includes press rolls 118 and 120, a traveling press fabric 122 and rolls 124, all of conventional construction.

Drying section 106 includes a drier cylinder 126, a traveling drying fabric 150 of conventional construction.

In the paper making assembly 100, suspension fibers 146 is delivered from head box 108 to traveling fabric 110 by means of which they are fed through the forming section 102. The resulting web 148 is fed between press rolls 118 and 120 of press section 104 and is fed to drier section 106.

The afore-going description is all conventional in a paper making machine.

The paper making machine 100 further includes an apparatus 132 corresponding to apparatus 10 of FIG. 1 hereinbefore mounted on a holder 134. Cleaning unit 136 is operatively connected to a control unit 138 which is connected to apparatus 132.

The holder 134 is mounted for travel back and forth in the cross direction of the fabric 122 as indicated by the arrows A and by the showing of apparatus 132 and holder 134 in broken line to indicate the change in cross position of apparatus 132.

Sensor 140 detects the turns of the loops of fabric 122 which information is fed to an information processing means such as computer 138.

Similar sensors, not shown, may also be employed for detecting the turns of the machine loop of forming fabric 110 and drying fabric 150.

Fabrics 110 122 and 150 are pervious fabrics. In the embodiment illustrated in FIG. 7 the apparatus 132 is located to detect plugged sites in the pervious fabric belt 122 of press section 104 but could likewise be used to detect plug sites and holes in the pervious fabric 110 of the forming section 102 or the pervious fabric 150 of the drying section 106.

We claim:

1. An apparatus for detecting plugged sites and holes of an endless pervious traveling fabric for supporting a paper web in a papermaking machine, said apparatus comprising:

i) nozzle means having a nozzle orifice positioned and arranged to engage a surface of said pervious traveling fabric which is not supporting the paper web, for directing, under an essentially constant pressure, a stream of water through interstices of said pervious traveling fabric;

ii) a pressure pulse sensor operably housed in said nozzle means for sensing pressure changes developed in the stream, responsive to interruptions of water flow through said pervious traveling fabric.

2. An apparatus according to claim 1 wherein said nozzle means has a smooth, and rounded outer face engaged at a right angle to said pervious traveling fabric.

3. An apparatus according to claim 1 wherein said apparatus further includes a conduit means to said nozzles and a flow meter a pressure regulator operatively connected to said conduit means for regulating a constant flow of water through said nozzle means, said flow meter providing a measure of the water permeability of said pervious travelling fabric.

4. An apparatus according to claim 3 wherein said apparatus further includes information processing means operatively connected to said pressure regulator and said flow meter for collecting, storing and recording data developed by the pressure pulse sensor and the flow meter for evaluating fabric efficiency indicative of either a plugged site or a hole in said pervious traveling fabric.

5. An apparatus according to claim 4 said apparatus further including cleaning means operatively connected to said information processing means, for cleaning a detected plugged site on said pervious traveling fabric to improve its efficiency.

6. An apparatus according to claim 4 wherein said apparatus is supported by a holder mounted to travel back and forth in the cross-direction of said pervious traveling fabric, and means to effect such travel so that said nozzle orifice is shifted back and forth across said pervious traveling fabric to provide a cross-machine permeability profile of said pervious traveling fabric and a cross-machine detection of plugged sites and holes of said pervious traveling fabric.

7. An apparatus according to claim 6 wherein said apparatus further includes sensor means for detecting each turn of a machine loop of said pervious traveling fabric, said sensor means having an output for determining a measured position in the machine direction of said pervious traveling fabric for determination with said information processing means, of the machine direction permeability and machine direction positions of plugged sites and holes.

* * * * *